United States Patent [19]

Hulek

[11] 4,295,637

[45] Oct. 20, 1981

[54] GUARD RAIL

[76] Inventor: Anton Hulek, Goglerfeldgasse 15, A-4020 Linz, Austria

[21] Appl. No.: 150,075

[22] Filed: May 15, 1980

[30] Foreign Application Priority Data

May 23, 1979 [AT] Austria ..... 3775/79

[51] Int. Cl.[3] ..... A01K 3/00

[52] U.S. Cl. ..... 256/13.1; 52/635; 29/6.1

[58] Field of Search ..... 256/13.1; 52/635; 29/6.1, 455 LM, 150

[56] References Cited

U.S. PATENT DOCUMENTS

| | | | |
|---|---|---|---|
| 3,108,406 | 10/1963 | Ellis | 52/635 X |
| 3,333,379 | 8/1967 | Harris | 52/635 X |
| 4,000,882 | 1/1977 | Penton | 256/13.1 |

FOREIGN PATENT DOCUMENTS

| | | | |
|---|---|---|---|
| 1162090 | 3/1958 | France | 52/635 |
| 1010817 | 11/1965 | United Kingdom | 256/13.1 |

*Primary Examiner*—Andrew V. Kundrat
*Attorney, Agent, or Firm*—Kurt Kelman

[57] ABSTRACT

A guard rail for use alongside a road or lane comprises two profiled side portions on opposite sides of the guard rail. Said side portions are joined by a gridlike web.

5 Claims, 2 Drawing Figures

GUARD RAIL

Figure 1:
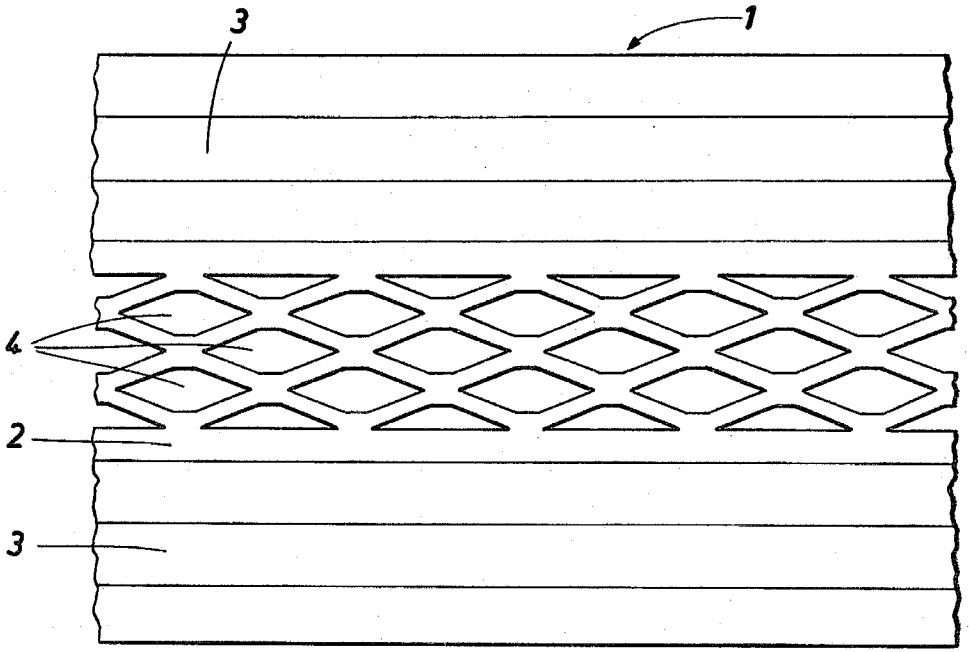

This invention relates to a guard rail for use alongside a road or lane, comprising two substantially U-shaped, longitudinally extending side portions connected by a web.

Such guard rails are widely used mainly to prevent vehicles from leaving the road or lane when this is not intended or, when arranged between two lanes, to protect the drivers of vehicles against dazzling light from opposing vehicles. Such guard rails have mainly been made from sheet steel in a width of about 300 mm and have been more or less similar in cross-section and mounted in suitable positions alongside the roads or lanes. The known guard rails do not adequately meet the requirements to be fulfilled by them because they are so narrow that they can hardly afford protection against dazzling light from opposing vehicles, and vehicles impinging on such a guard rail can easily tilt or overturn and may then fall over the guard rail, particularly when the vehicle is large and/or has a relatively high center of gravity. Vehicles which overturn on the road as a result of an accident are often catapulted over the guard rail. It is apparent that just in particularly critical situations the known guard rails afford virtually no protection unless two or more rails are mounted one over the other. Such expensive arrangements are required also at exposed road portions. Another serious disadvantage of the known guard rails resides in that they have only a relatively small plastic deformability so that they can dissipate only a small amount of kinetic energy from impinging vehicles and such vehicles may be thrown back onto the road or lane, with dangerous results.

It is an object of the invention to eliminate these disadvantages and to provide a guard rail which is of the kind described first hereinbefore and affords greatly improved protection whereas the cost of manufacturing the guard rail is only slightly increased.

This object is accomplished according to the invention in that the web which connects the U-shaped side portions of the guard rail is perforated to form a grid. The use of such a gridlike web permits the guard rail to be made much wider while the weight of the guard rail is only slightly increased. As a result, the guard rails according to the invention afford a greatly improved protection against a tilting and overturning of impinging vehicles and against dazzling light from opposing traffic and also afford an improved protection of roadside residents from traffic noise. A catapulting of a vehicle over such guard rails is also virtually impossible. A special advantage afforded by the gridlike web resides in that it increases the plastic deformability of the guard rail so that the latter is capable of dissipating a large portion of the kinetic energy of a vehicle which impinges on the guard rail and the impact of the vehicle will be damped by the guard rail and there will be a much lower tendency for the vehicle to bounce because the elastic deformation of the guard rail is decreased. A vehicle impinging on a wide guard rail will partly become wedged under the guard rail so that the friction surface area and with it the friction force will be increased and the distance over which a vehicle can be thrown back will be shortened. The gridlike web may be described as an intercepting net which is integrated in the profiled rail. The perforated web does not only improve the protection afforded by the guard rail but also improves its appearance.

The costs of manufacturing the guard rails may be decreased if the connecting web consists of an expanded grid which is formed during the shaping of the profiled guide rail.

The guard rail which has been expanded and profiled may subsequently be annealed. This heat treatment will increase the plastic deformability of the profiled guard rail made from sheet steel. It will be sufficient to anneal the guard rail only in the zone comprising the web.

The materials from which the profiled guard rail according to the invention may be made include sheet steel, aluminum alloy and plastic material.

Owing to their relatively large width, the guard rails according to the invention have also a sound-insulating effect and can actually be used for protection from noise. The protection from noise afforded by the guard rail and its resistance to corrosion may be increased by coating the guard rails with plastic or by making them from sandwich material.

Figure 2:
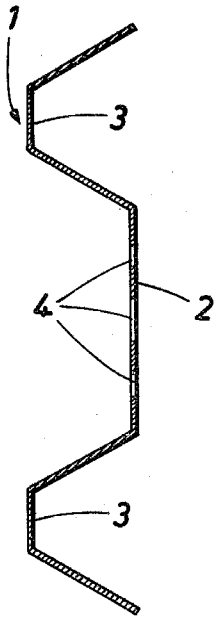

An embodiment of a guard rail according to the invention is shown by way of example on the drawing in FIG. 1 in a side elevation and in FIG. 2 in a transverse sectional view.

A guard rail 1 for use along the side of a road or lane consists substantially of two U-shaped portions 3, which are connected by a wide, gridlike web 2, which is formed with mesh openings 4. In the present embodiment, the web 3 consists of an expanded mesh. The essential feature of said guard rail 1 is not the shape of the side portions but the design of the gridlike web 2, which permits the guard rail 1 to be made in a large width and imparts to the guard rail a high plastic deformability although the guard rail still has an adequate stiffness.

What is claimed is:

1. In a guard rail for use alongside a road, which comprises a sheet material profiled to form two substantially U-shaped side portions extending longitudinally of the guard rail and a web interconnecting the side portions, the two side portions and the web defining a substantially U-shaped recess therebetween and the side portions projecting substantially perpendicularly from a plane defined by the web, the U-shaped side portions having the base of the U radially spaced from and substantially parallel to said plane, the improvement of the web being a grid.

2. In the guard rail of claim 1, the grid being an expanded mesh.

3. In the guard rail of claim 1 or 2, the sheet material being of metal coated with a synthetic resin.

4. In a process of manufacturing a guard rail, which comprises the step of profiling a sheet material to form two substantially U-shaped side portions extending longitudinally of the guard rail and a web interconnecting the side portions, the two side portions and the web defining a substantially U-shaped recess therebetween and the side portions projecting substantially perpendicularly from a plane defined by the web, the U-shaped side portions having the base of the U radially spaced from and substantially parallel to said plane, the improvement of perforating the web and expanding the perforated web to form an expanded mesh between the side portions.

5. In the process of claim 4, wherein the sheet material is sheet steel, the step of annealing the expanded mesh.

* * * * *